US009098055B2

(12) United States Patent
Maul

(10) Patent No.: US 9,098,055 B2
(45) Date of Patent: Aug. 4, 2015

(54) METHODS AND SYSTEMS FOR LOCKING A REPLACEABLE UNIT IN AN IMAGE FORMING DEVICE

(71) Applicant: Lexmark International, Inc., Lexington, KY (US)

(72) Inventor: Michael David Maul, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/108,997

(22) Filed: Dec. 17, 2013

(65) Prior Publication Data

US 2015/0168910 A1 Jun. 18, 2015

(51) Int. Cl.
*G03G 21/16* (2006.01)

(52) U.S. Cl.
CPC ..... *G03G 21/1647* (2013.01)

(58) Field of Classification Search
CPC ..... G03G 21/1647
USPC ..... 399/24, 25, 80, 107, 110, 111, 167
See application file for complete search history.

(56) References Cited

U.S. PATENT DOCUMENTS

| | | | | |
|---|---|---|---|---|
| 5,993,101 | A | 11/1999 | Kohno et al. | |
| 6,035,159 | A | 3/2000 | Azuma et al. | |
| 6,076,419 | A | 6/2000 | Mlejnek et al. | |
| 6,397,029 | B1 | 5/2002 | Portig | |
| 6,768,877 | B2 * | 7/2004 | Alegria et al. | 399/24 X |
| 6,856,779 | B2 | 2/2005 | Ota et al. | |
| 6,892,033 | B2 * | 5/2005 | Sunada et al. | 399/111 X |
| 7,043,180 | B2 | 5/2006 | Askren et al. | |
| 7,130,562 | B2 | 10/2006 | Foster et al. | |
| 7,228,090 | B2 | 6/2007 | Toso et al. | |
| 7,236,722 | B2 | 6/2007 | Portig | |
| 7,386,252 | B2 | 6/2008 | Portig et al. | |
| 8,064,800 | B2 | 11/2011 | Carter et al. | |
| 8,150,297 | B2 | 4/2012 | Gayne et al. | |
| 8,257,185 | B2 | 9/2012 | Carter et al. | |
| 8,316,733 | B2 | 11/2012 | Malone et al. | |
| 8,615,184 | B2 | 12/2013 | Zhou et al. | |
| 8,855,534 | B2 | 10/2014 | Jung et al. | |
| 2008/0219709 | A1 | 9/2008 | Hebner et al. | |
| 2009/0129823 | A1 | 5/2009 | Koshimori et al. | |

(Continued)

OTHER PUBLICATIONS

U.S. Appl. No. 14/108,958, filed Dec. 17, 2013.

(Continued)

*Primary Examiner* — Sandra Brase
(74) *Attorney, Agent, or Firm* — Justin M Tromp

(57) ABSTRACT

An image forming device according to one example embodiment includes a drive coupler positioned to provide rotational force to a corresponding drive coupler of a replaceable unit when the replaceable unit is installed in the image forming device. The image forming device is configured to rotate the drive coupler of the image forming device in an operative rotational direction of the drive coupler of the replaceable unit until the drive coupler of the image forming device locks with the drive coupler of the replaceable unit upon receiving a lock command and to rotate the drive coupler of the image forming device in a direction opposite the operative rotational direction of the drive coupler of the replaceable unit until the drive coupler of the image forming device unlocks from the drive coupler of the replaceable unit upon receiving an unlock command.

17 Claims, 12 Drawing Sheets

(56) References Cited

U.S. PATENT DOCUMENTS

| | | | |
|---|---|---|---|
| 2013/0170865 | A1 | 7/2013 | Carter et al. |
| 2013/0170866 | A1 | 7/2013 | Carter et al. |
| 2013/0170872 | A1 | 7/2013 | Buchanan et al. |
| 2013/0209141 | A1 | 8/2013 | Hackney |
| 2014/0255060 | A1 | 9/2014 | Leemhuis et al. |

OTHER PUBLICATIONS

Non-Final Office Action for U.S. Appl. No. 14/108,958 dated Dec. 16, 2014.

Non-Final Office Action for U.S. Appl. No. 14/108,958 dated May 1, 2015.

* cited by examiner

METHODS AND SYSTEMS FOR LOCKING A REPLACEABLE UNIT IN AN IMAGE FORMING DEVICE

CROSS REFERENCES TO RELATED APPLICATIONS

None.

BACKGROUND

1. Field of the Disclosure

The present disclosure relates generally to image forming devices and more particularly to methods and systems for locking a replaceable unit in an image forming device.

2. Description of the Related Art

Image forming devices such as electrophotographic printers, copiers and multifunction devices commonly include one or more replaceable units that have a shorter lifespan than the image forming device does. As a result, the replaceable unit must be replaced by the user from time to time in order to continue operating the image forming device. For example, an electrophotographic image forming device's toner supply is typically stored in one or more replaceable units. In some devices, imaging components having a longer life are separated from those having a shorter life in separate replaceable units. In this configuration, relatively longer life components such as a developer roll, a toner adder roll, a doctor blade and a photoconductive drum may be positioned in one or more replaceable units referred to as imaging units. The image forming device's toner supply, which is consumed relatively quickly in comparison with the components housed in the imaging unit(s), may be provided in a reservoir in a separate replaceable unit in the form of a toner cartridge or bottle that supplies toner to one or more of the imaging unit(s). Other components of the electrophotographic image forming device such as a fuser may also be replaceable. These replaceable units require periodic replacement by the user such as when the toner cartridge runs out of usable toner, when a replaceable unit's components reach the end of their life due to wear, when a waste toner reservoir fills with waste toner, etc.

Image forming devices are used in a variety of settings such as businesses and schools. In settings where physical access to the image forming device is generally unrestricted, the replaceable units of the image forming device may be a target for theft for purposes such as resale or home use. For example, some schools where theft from image forming devices is common require school staff to remove and securely store the replaceable units at the end of each school day. In addition to the inconvenience and burden imposed on the staff, daily removal and reinsertion of the replaceable units out of and into the image forming device may, over time, result in electrical system failure due to excessive wear on the electrical contacts of the replaceable units and the corresponding electrical contacts in the image forming device as well as toner leakage due to excessive wear on toner seals.

One solution is to lock the replaceable unit to the image forming device or to lock an access door on the image forming device that permits access to the replaceable unit using a physical lock and key. However, this solution requires safekeeping of the key to the image forming device creating an additional burden on the end user. Another solution known in the art is for the printer to contain a lock mechanism (such as a solenoid lock) on the access door to the image forming device that is controlled by the image forming device and that restricts access to the replaceable unit(s). However, this approach requires additional parts and installation of those parts in the image forming device thereby adding significant manufacturing cost to the device. Accordingly, a secure, user-friendly, low cost system for locking a replaceable unit in an image forming device is desired.

SUMMARY

A method of locking a replaceable unit in an image forming device according to one example embodiment includes upon receiving a lock command with the replaceable unit installed in the image forming device and a drive coupler of the image forming device mated with a drive coupler of the replaceable unit at an axial end of the drive coupler of the replaceable unit, rotating the drive coupler of the image forming device in an operative rotational direction of the drive coupler of the replaceable unit until the drive coupler of the image forming device locks with the drive coupler of the replaceable unit preventing the drive coupler of the replaceable unit from axially disengaging from the drive coupler of the image forming device.

A method of unlocking a replaceable unit from an image forming device according to one example embodiment includes upon receiving an unlock command with the replaceable unit installed in the image forming device and a drive coupler of the image forming device locked with a drive coupler of the replaceable unit at an axial end of the drive coupler of the replaceable unit, rotating the drive coupler of the image forming device in a direction opposite an operative rotational direction of the drive coupler of the replaceable unit until the drive coupler of the replaceable unit is free to axially disengage from the drive coupler of the image forming device.

An image forming device configured to hold a replaceable unit installable in the image forming device according to one example embodiment includes a drive coupler positioned to provide rotational force to a corresponding drive coupler of the replaceable unit when the replaceable unit is installed in the image forming device. A drive motor is operatively connected to the drive coupler of the image forming device to drive the rotational motion of the drive coupler of the image forming device. At least one processor is configured to rotate the drive motor to drive the drive coupler of the image forming device in an operative rotational direction of the drive coupler of the replaceable unit until the drive coupler of the image forming device locks with the drive coupler of the replaceable unit upon receiving a lock command with the replaceable unit installed in the image forming device and the drive coupler of the image forming device mated with but unlocked from the drive coupler of the replaceable unit. The at least one processor is configured to rotate the drive motor to drive the drive coupler of the image forming device in a direction opposite the operative rotational direction of the drive coupler of the replaceable unit until the drive coupler of the image forming device unlocks from the drive coupler of the replaceable unit upon receiving an unlock command with the replaceable unit installed in the image forming device and the drive coupler of the image forming device locked with the drive coupler of the replaceable unit.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
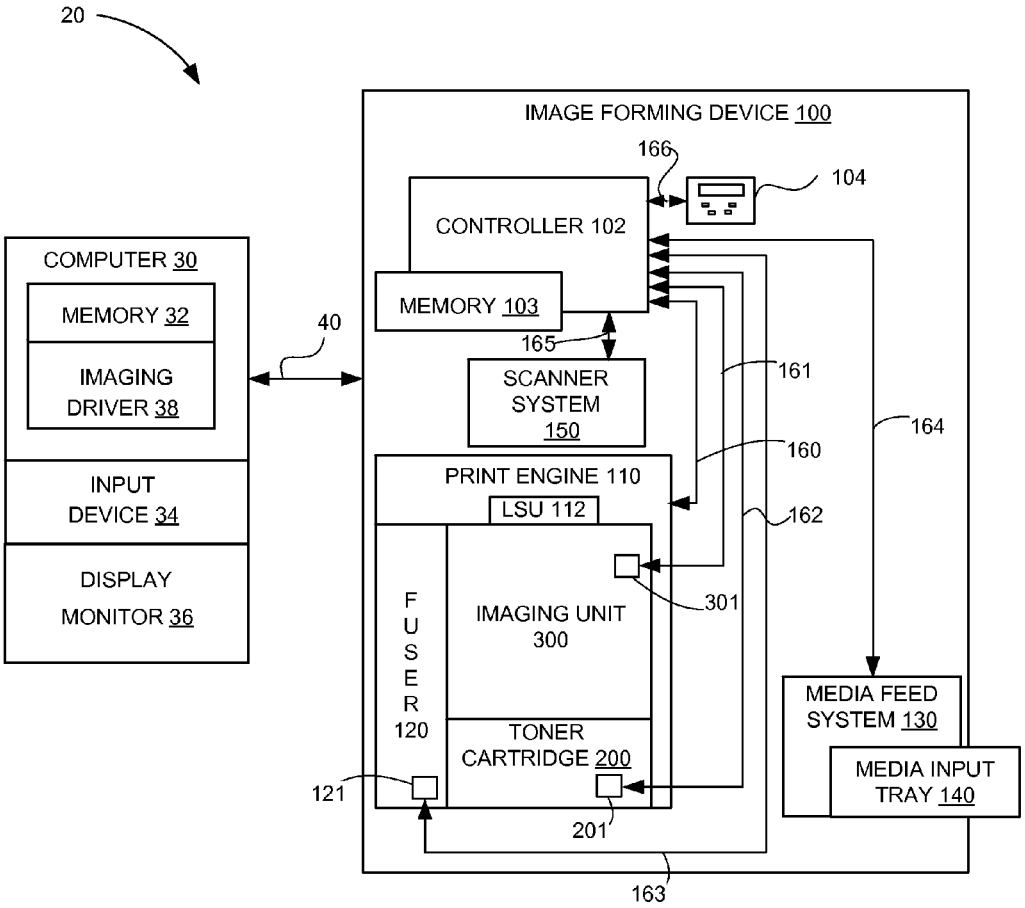
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
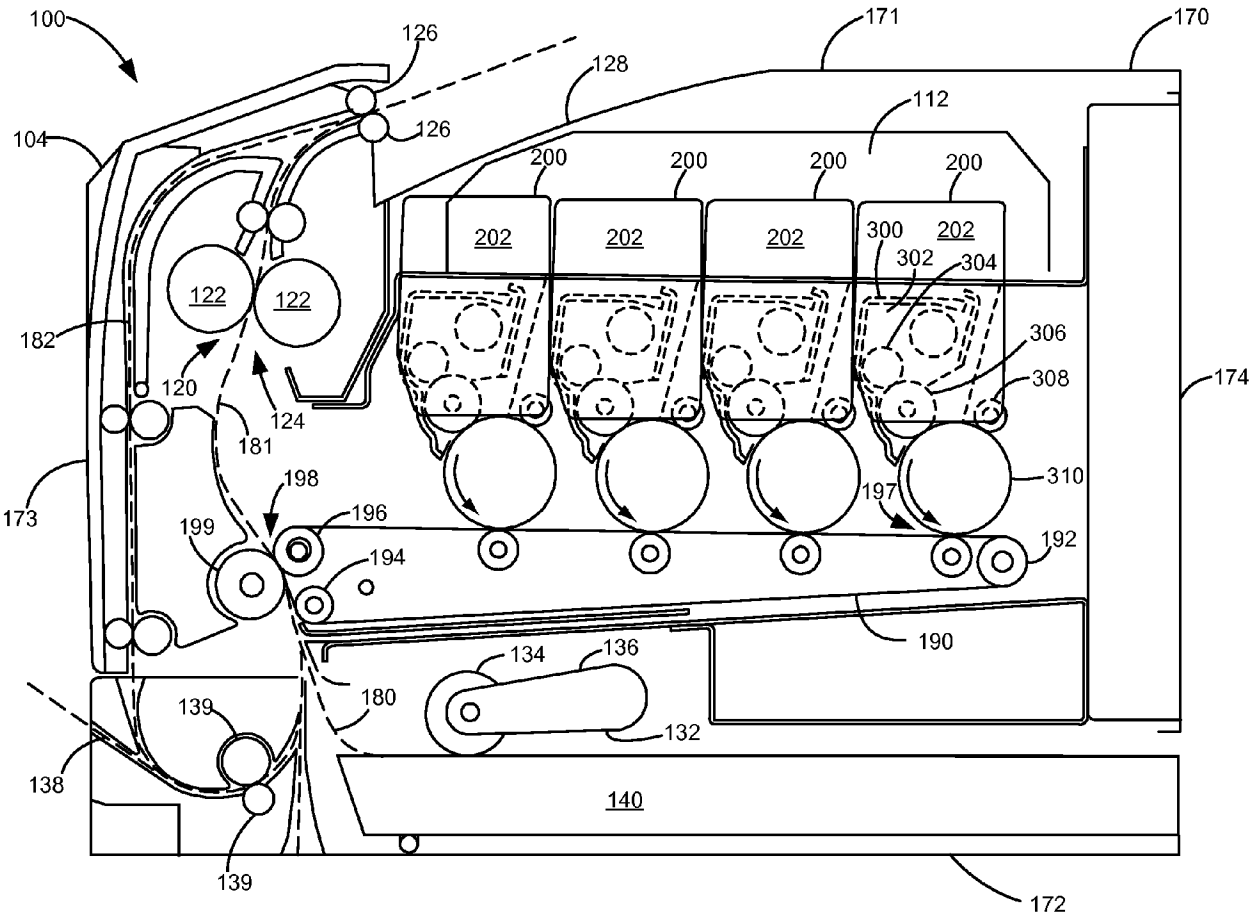
FIG. 2 is a schematic diagram of an image forming device according to a first example embodiment.

FIG. 2 illustrates a schematic view of the interior of an example image forming device 100. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include black, cyan, yellow and magenta toner, respectively. In the example embodiment illustrated, each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. For purposes of clarity, the components of only one of the imaging units 300 are labeled in FIG. 2. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

In the example embodiment illustrated, an intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
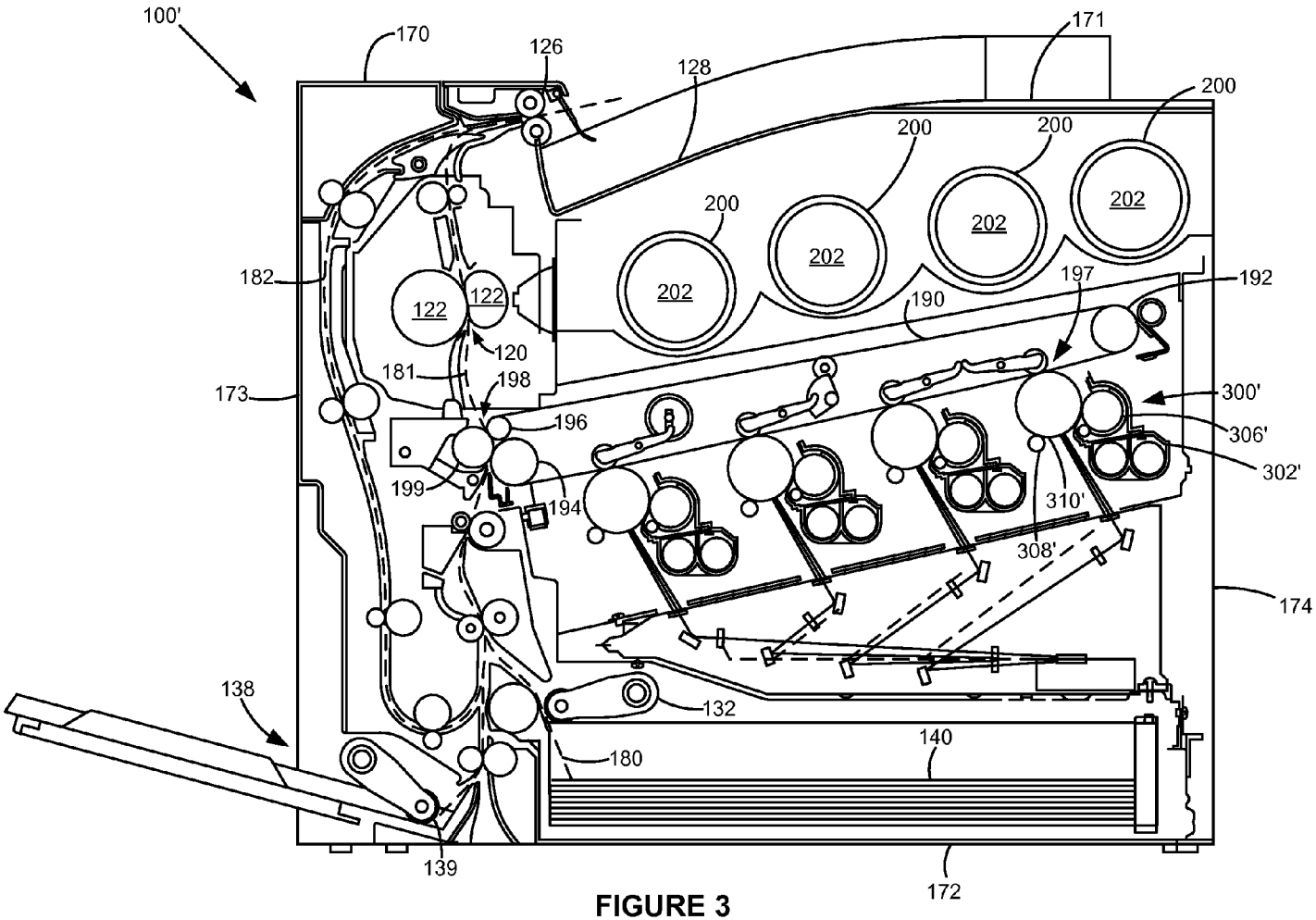
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310' which is charged by a corresponding charge roll 308'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although imaging forming devices 100 and 100' utilize ITM 190 to transfer toner to the media, toner may be applied directly to the media by the one or more photoconductive drums 310, 310' as is known in the art. In addition, toner may be transferred directly from each toner cartridge 200 to its corresponding imaging unit 300 or 300' or the toner may pass through an intermediate component such as a chute or duct that connects the toner cartridge 200 with its corresponding imaging unit 300 or 300'.

The configurations of toner cartridges 200 and imaging units 300, 300' shown in FIGS. 2 and 3 are meant to serve as examples and are not intended to be limiting. For instance, although the example image forming devices discussed above include a pair of mating replaceable units in the form of toner cartridge 200 and imaging unit 300 or 300', it will be appreciated that the replaceable unit(s) of the image forming device may employ any suitable configuration as desired. For example, in one embodiment, the main toner supply for the image forming device and the components of imaging unit 300 or 300' are housed in a single replaceable unit. In another embodiment, the main toner supply for the image forming device, toner adder roll 304 and developer roll 306 are provided in a first replaceable unit and photoconductive drum 310 and charging roll 308 are provided in a second replaceable unit. In another embodiment, toner adder roll 304 and developer roll 306 are provided in a first replaceable imaging unit and photoconductive drum 310 and charging roll 308 are provided in a second replaceable imaging unit. Similarly, in one embodiment, reservoir 302' and magnetic roll 306' are provided in a first replaceable imaging unit and charge roll 308' and photoconductive drum 310' are provided in a second replaceable imaging unit. One skilled in the art will appreciate that many other combinations and configurations of toner cartridges 200 and imaging units 300, 300' may be used as desired.

Figure 4:
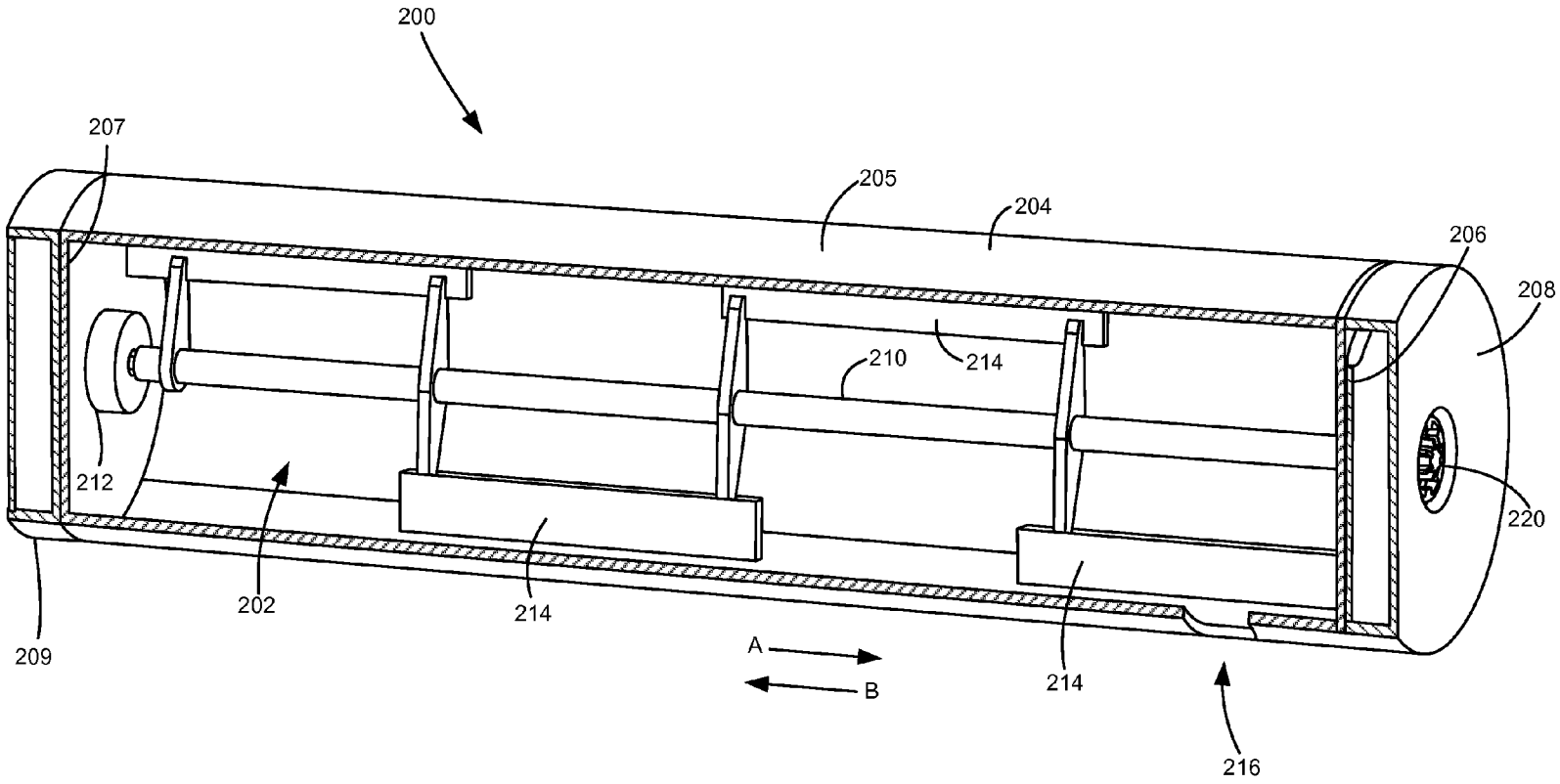
FIG. 4 is a perspective side view of a replaceable unit according to one example embodiment having a portion of a body of the replaceable unit removed to illustrate an internal toner reservoir.

With reference to FIG. 4, a replaceable unit in the form of a toner cartridge 200 is shown according to one example embodiment. Toner cartridge 200 includes a body 204 that includes walls forming toner reservoir 202. In the example embodiment illustrated, body 204 includes a generally cylindrical wall 205 and a pair of end walls 206, 207. In this embodiment, end caps 208, 209 are mounted on end walls 206, 207, respectively such as by suitable fasteners (e.g., screws, rivets, etc.) or by a snap-fit engagement. FIG. 4 shows toner cartridge 200 with a portion of body 204 removed to illustrate the internal components of toner cartridge 200. A rotatable shaft 210 extends along the length of toner cartridge 200 within toner reservoir 202. As desired, the ends of rotatable shaft 210 may be received in bushings or bearings 212 positioned on an inner surface of end walls 206, 207. One or more agitators 214 (e.g., paddle(s), auger(s), etc.) may be mounted on and rotate with shaft 210 to stir and move toner within reservoir 202 as desired. An outlet port 216 is positioned to exit toner from reservoir 202. In the example embodiment illustrated, outlet port 216 is positioned on a bottom portion of body 204 near end wall 206; however, outlet port 216 may be positioned in any suitable position. As desired, outlet port 216 may include a shutter or a cover (not shown) that is movable between a closed position blocking outlet port 216 to prevent toner from flowing out of toner cartridge 200 and an open position permitting toner flow.

A drive coupler 220 is positioned on an exterior portion of body 204 on a leading portion of toner cartridge 200 with respect to its insertion direction into the image forming device. In the example embodiment illustrated, toner cartridge 200 is inserted into the image forming device along lengthwise direction A and removed from the image forming device along opposite lengthwise direction B. Accordingly, in the example embodiment illustrated, drive coupler 220 is mounted on an outer surface of end wall 206 positioned at the front of toner cartridge 200 as toner cartridge 200 enters the image forming device. When toner cartridge 200 is installed in the image forming device, drive coupler 220 receives rotational force from a corresponding drive coupler in the image forming device to rotate shaft 210. Shaft 210 may be connected directly or by one or more intermediate gears to drive coupler 220.

Figure 5:
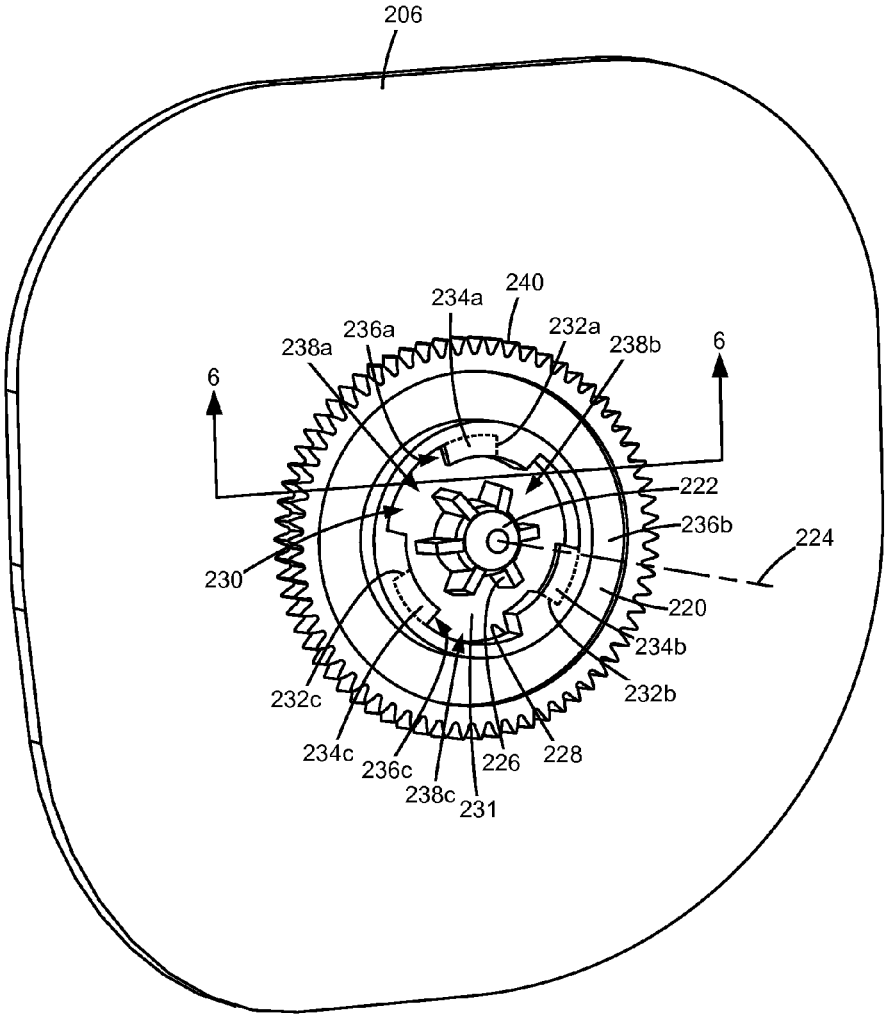
FIG. 5 is a perspective view of a drive coupler of the replaceable unit according to one example embodiment.

FIG. 5 shows drive coupler 220 of the replaceable unit in greater detail according to one example embodiment. In this embodiment, drive coupler 220 includes a hub 222 positioned at an axis of rotation 224 of drive coupler 220. Hub 222 includes spokes 226 extending radially therefrom. In some embodiments, a height of hub 222 in the axial direction decreases from a peak at axis of rotation 224 to the outer radial portions of hub 222. For example, in one embodiment, hub 222 is shaped like a rounded cone or mound having a peak at axis of rotation 224 and tapering in height toward the outer radial portions of hub 222. Similarly, in some embodiments, a height of each spoke 226 decreases as the spoke 226 extends radially outward from axis of rotation 224.

An outer circumferential guide 228 is positioned around hub 222 and spokes 226. In the example embodiment illustrated, circumferential guide 228 substantially encircles hub 222 and spokes 226. In this embodiment, circumferential guide 228 defines an axially inset cavity 230 in the outer axial end of drive coupler 220 having hub 222 and spokes 226 positioned in cavity 230. Circumferential guide 228 is sized to receive the corresponding drive coupler of the image forming device as the replaceable unit is installed along insertion direction A, i.e., along the axial outward direction of drive coupler 220.

Figure 6:
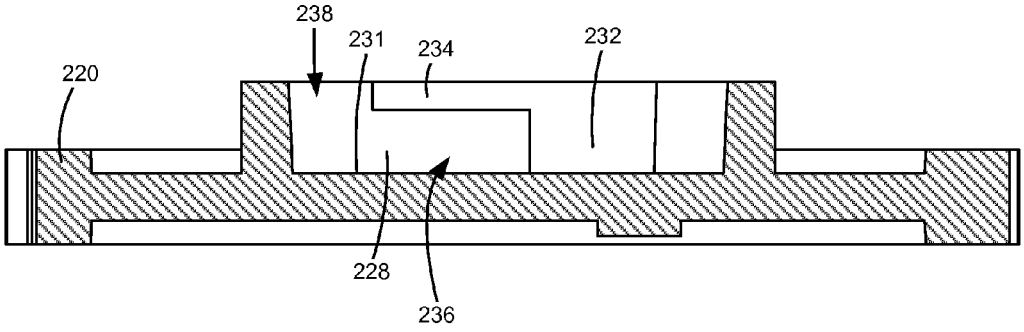
FIG. 6 is a cross-sectional view of the drive coupler of the replaceable unit shown in FIG. 5.

With reference to FIGS. 5 and 6, one or more stops 232 extend radially inward from circumferential guide 228 and are spaced circumferentially from each other about circumferential guide 228. For example, the example embodiment shown in FIG. 5 includes three stops 232*a*, 232*b* and 232*c*. However, more or fewer than three stops 232 may be used as desired. An axial locking member 234 in the form of a tab, flange or other restraining member extends circumferentially from one end of one or more of the stops 232 in a direction counter to the operative rotational direction of drive coupler 220. The example embodiment shown in FIG. 5 includes three axial locking members 234*a*, 234*b* and 234*c*, one axial locking member 234 extending from each stop 232. In the example embodiment illustrated, in operation, drive coupler 220 turns in a clockwise direction as viewed in FIG. 5. As a result, in this embodiment, axial locking members 234*a*, 234*b* and 234*c* extend in a counterclockwise direction from their respective stops 232*a*, 232*b* and 232*c* as viewed in FIG. 5. Axial locking members 234*a*, 234*b* and 234*c* are spaced axially outward from an axial end surface 231 of cavity 230 substantially surrounded by circumferential guide 228 such that a pocket 236 is formed between each axial locking member 234 and surface 231. Accordingly, the example embodiment illustrated includes three pockets 236*a*, 236*b* and 236*c*. Each axial locking member 234 extends circumferentially part of the way from one stop 232 to the next stop 232 such that an axial opening 238 is formed in the direction counter to the operative rotational direction of drive coupler 220 (counterclockwise in the example embodiment as viewed in FIG. 5) between a distal end of the axial locking member 234 and the next stop 232. For example, in the example embodiment illustrated, an axial opening 238*a* extends from a distal end of axial locking member 234*a* to stop 232*c*. Similarly, an axial opening 238*b* extends from a distal end of axial locking member 234*b* to stop 232*a* and an axial opening 238*c* extends from a distal end of axial locking member 234*c* to stop 232*b*.

Drive coupler 220 may include gear teeth 240 on an outer radial portion thereof as shown in the example embodiment illustrated. Gear teeth 240 transfer rotational force to one or more additional gears positioned on end wall 206. In this embodiment, shaft 210 may be connected directly to drive coupler 220 or to one of the gears that receives rotational force from drive coupler 220. Alternatively, drive coupler 220 may omit gear teeth 240 and shaft 210 may extend axially inward from drive coupler 220 such that rotational force is transferred directly to shaft 210 by drive coupler 220.

Figure 7:
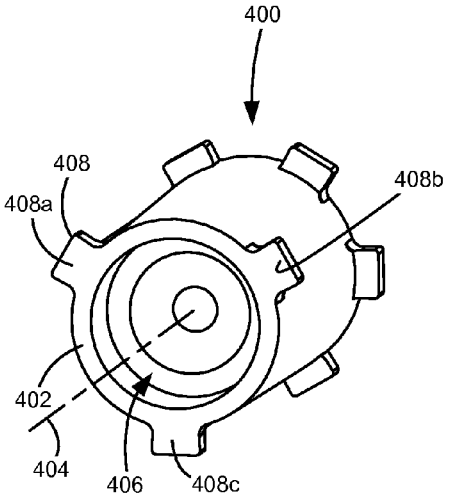
FIG. 7 is a perspective view of a corresponding drive coupler of the image forming device according to one example embodiment.

FIG. 7 shows a drive coupler 400 of the image forming device according to one example embodiment. In the example embodiment illustrated, a front portion 402 of drive coupler 400 mates with drive coupler 220 of the replaceable unit. Drive coupler 400 includes an axis of rotation 404. Front portion 402 of drive coupler 400 includes a central opening 406 sized to receive hub 222 and spokes 226 of drive coupler 220. In operation, as the replaceable unit is inserted into the image forming device along insertion direction A, when drive coupler 220 begins to contact drive coupler 400, hub 222 and spokes 226 engage with and are received in opening 406. As drive coupler 220 and drive coupler 400 engage, the tapered axial height of hub 222 and spokes 226 urges drive coupler 400 into alignment with drive coupler 220 and circumferential guides 228 further align drive coupler 400 with drive coupler 220 so that axis of rotation 224 of drive coupler 220 aligns with axis of rotation 404 of drive coupler 400. Drive coupler 400 also includes one or more drive elements such as, for example, prongs 408 extending radially outward therefrom. Generally, the number of prongs 408 of drive coupler 400 corresponds with the number of stops 232 of drive coupler 220; however, drive coupler 400 may include more or less prongs 408 than drive coupler 220 includes stops 232 as desired. In the example embodiment illustrated, drive coupler 400 includes three prongs 408*a*, 408*b* and 408*c*.

Figure 8:
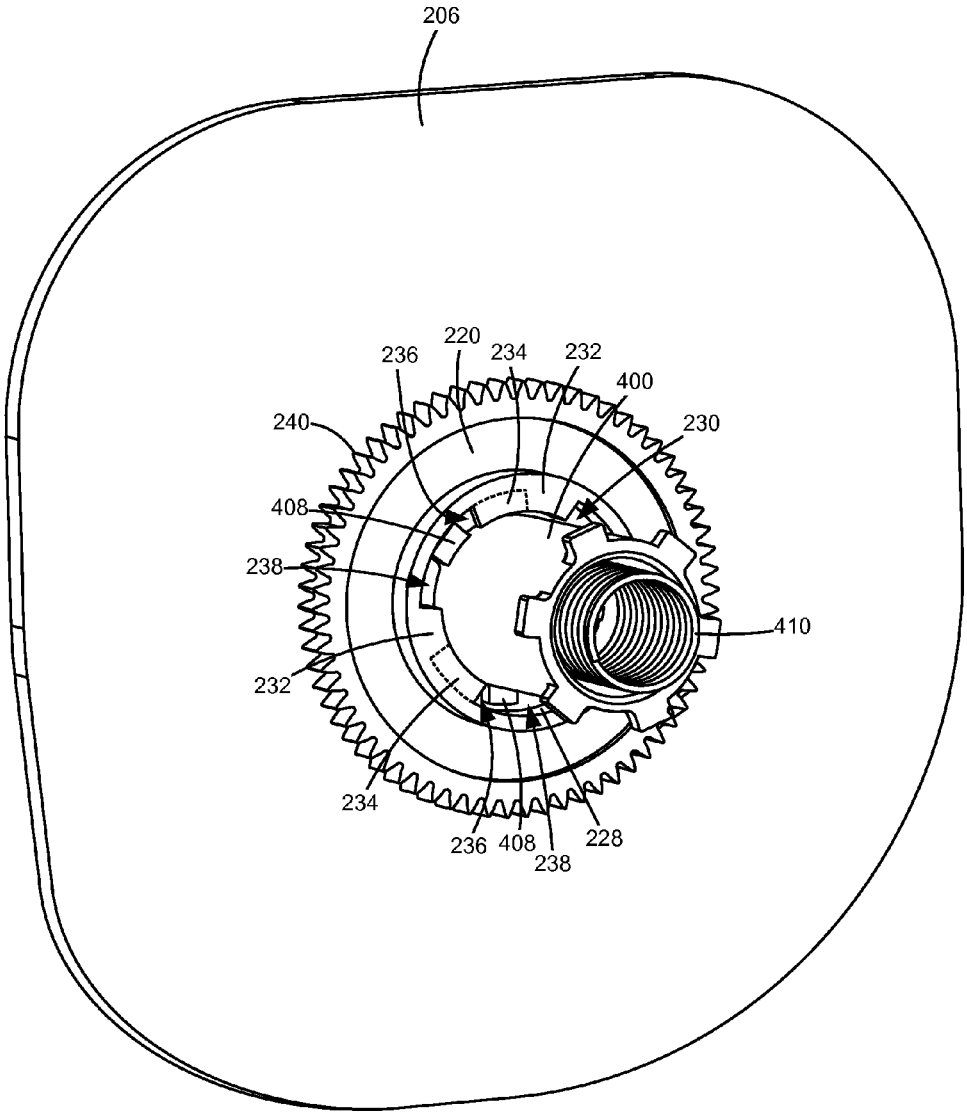
FIG. 8 is a perspective view of the drive coupler of the replaceable unit engaged with the corresponding drive coupler of the image forming device in an unlocked position.

FIG. 8 shows the replaceable unit fully inserted into the image forming device with drive coupler 220 engaged with drive coupler 400 in an unlocked position. Drive coupler 400 is biased toward drive coupler 220 in order to ensure reliable contact between the two to permit the transfer of rotational force from drive coupler 400 to drive coupler 220. For example, in the embodiment illustrated, a compression spring 410 biases drive coupler 400 toward drive coupler 220. When the replaceable unit is inserted into the image forming device, hub 222 and spokes 226 guide drive coupler 400, which is movable axially and radially to a certain degree, into alignment with drive coupler 220 so that drive coupler 400 is received in cavity 230. Depending on the orientation of drive coupler 400 relative to drive coupler 220, prongs 408 of drive coupler 400 may be received in axial openings 238 of drive coupler 220. Alternatively, prongs 408 may land on an outer axial surface of stops 232 or axial locking members 234. When this occurs, upon rotating drive coupler 400 (in the operative clockwise direction as viewed in FIG. 8), prongs 408 slide along the axial outer surface of axial locking members 234 and/or stops 232 until prongs 408 align with axial openings 238 at which point prongs 408 pass into axial openings 238 as a result of the bias applied to drive coupler 400. The bias applied to drive coupler 400 presses drive coupler 400 axially against axial end surface 231 of drive coupler 220 in order to maintain contact between drive coupler 400 and drive coupler 220. Circumferential guides 228 restrain drive coupler 400 from moving radially after drive coupler 400 is aligned with drive coupler 220 in order to maintain the alignment between drive coupler 400 and drive coupler 220. In the orientation shown in FIG. 8, prongs 408 of drive coupler 400 are positioned against axial end surface 231 of drive coupler 220 and aligned with axial openings 238. In this orientation, the replaceable unit may be freely removed from the image forming device in the removal direction B.

Figure 9:
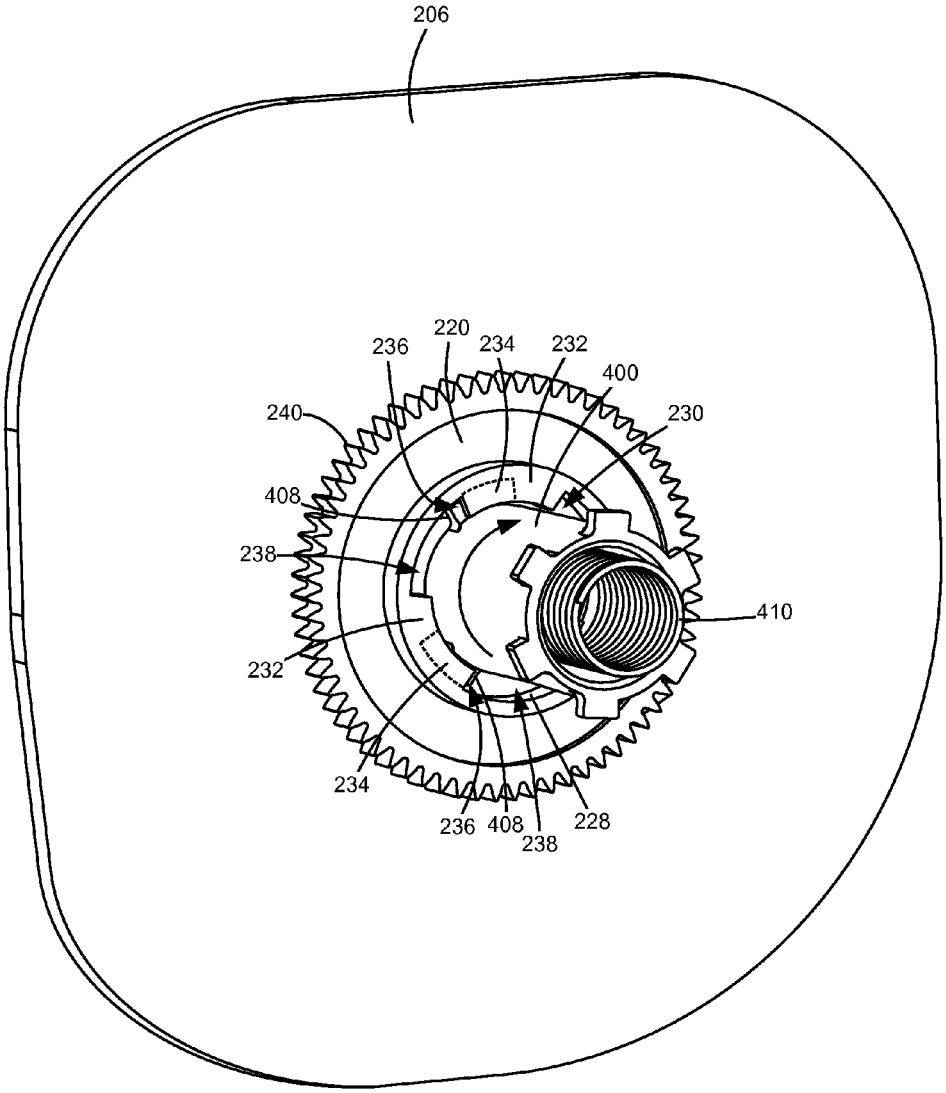
FIG. 9 is a perspective view of the drive coupler of the replaceable unit engaged with the corresponding drive coupler of the image forming device in a locked position.

FIG. 9 shows the replaceable unit fully inserted into the image forming device with drive coupler 220 engaged with drive coupler 400 in a locked position. In FIG. 9, drive coupler 400 is rotated in the operative (clockwise as viewed in FIG. 9) direction relative to its position in FIG. 8. When drive coupler 400 rotates in the operative direction after engaging with drive coupler 220, prongs 408 move from a position aligned with axial openings 238 into pockets 236 and against stops 232. As drive coupler 400 rotates further in the operative direction, the engagement between prongs 408 and stops 232 causes drive coupler 220 to rotate with drive coupler 400 thereby transferring rotational force from drive coupler 400 to drive coupler 220. In this orientation, prongs 408 are aligned with axial locking members 234. As a result, if a user tries to remove the replaceable unit along removal direction B, the engagement between prongs 408 and axial locking members 234 in the axial direction prevents the separation of drive coupler 220 from drive coupler 400. In this manner, once the replaceable unit is installed in the image forming device and drive coupler 400 of the image forming device is rotated in the operative direction, the engagement between drive coupler 220 and drive coupler 400 prevents the removal of the replaceable unit from the image forming device thereby locking the replaceable unit in the image forming device.

To permit removal of the replaceable unit from the image forming device, drive coupler 400 is rotated counter to the operative direction (counterclockwise as viewed in FIG. 9) until prongs 408 are aligned with axial openings 238 as shown in FIG. 8. Once prongs 408 are aligned with axial openings 238, axial locking members 234 no longer restrict the axial movement of the replaceable unit such that drive coupler 220 is separable from drive coupler 400 permitting a user to remove the replaceable unit from the image forming device. As a result, when prongs 408 are aligned with axial openings 238, the replaceable unit is unlocked from the image forming device.

While the example embodiment shown in FIGS. 5-9 includes drive coupler 220 positioned on a toner cartridge 200, it will be appreciated that a drive coupler having axial locking members like axial locking members 234 of drive coupler 220 may be provided on any replaceable unit of the image forming device such as, for example, one or more of imaging unit(s) 300 or 300' or fuser 120. Further, although the example embodiment shown includes axial locking members 234 on the drive coupler 220 of the replaceable unit and prongs 408 that engage with the axial locking members 234 on drive coupler 400 of the image forming device, this configuration may be reversed as desired such that the drive coupler of the image forming device includes axial locking members and the drive coupler of the replaceable unit includes prongs that engage with the axial locking members to lock the replaceable unit in the image forming device.

The present disclosure is not limited to the specific embodiments of drive coupler 220 and drive coupler 400 illustrated in FIGS. 5-9. Rather, the drive couplers of the replaceable unit and the image forming device may be of any suitable construction that provides a locked state preventing removal of the replaceable unit from the image forming device due to the engagement of the drive couplers of the replaceable unit and the image forming device and an unlocked state permitting removal of the replaceable unit from the image forming device.

Figure 10:
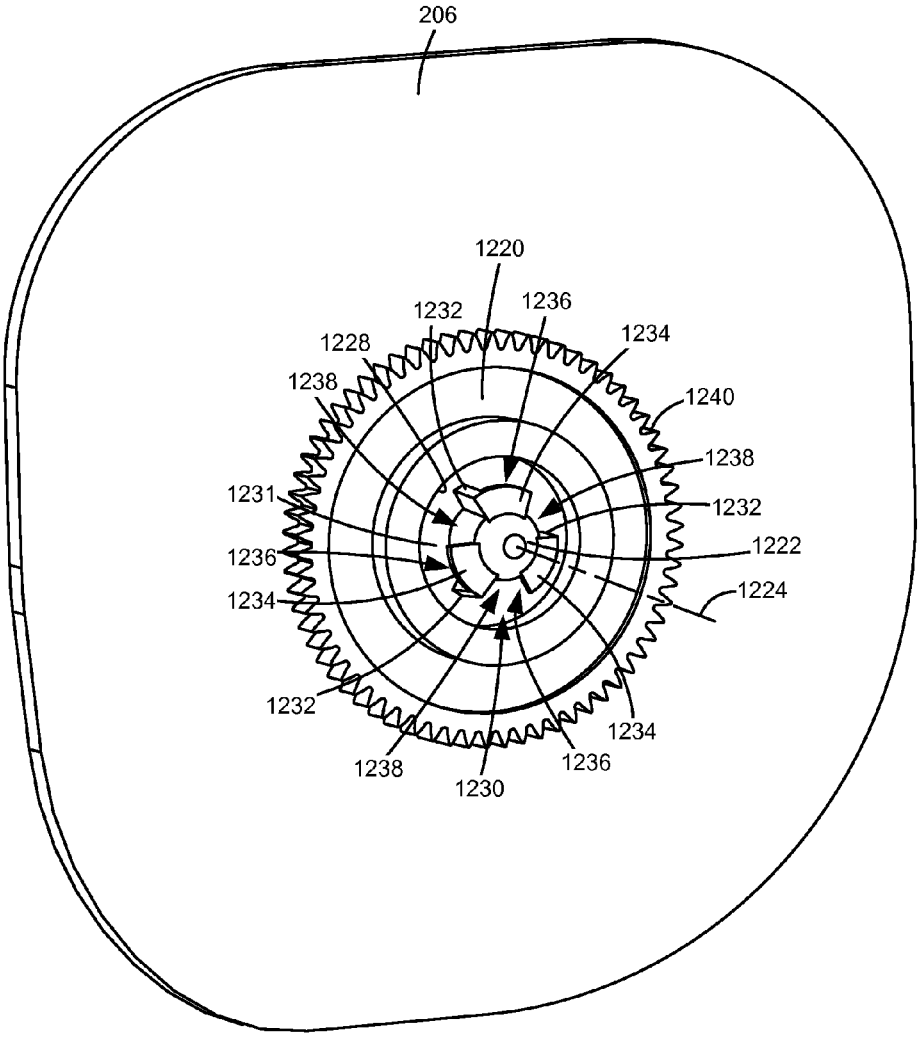
FIG. 10 is a perspective view of a drive coupler of the replaceable unit according to another example embodiment.

For example, FIG. 10 shows a drive coupler 1220 according to another example embodiment. Drive coupler 1220 includes a hub 1222 positioned at an axis of rotation 1224 of drive coupler 1220. An outer circumferential guide 1228 is positioned around hub 1222. In the example embodiment illustrated, circumferential guide 1228 substantially encircles hub 1222. In this embodiment, circumferential guide 1228 defines an axially inset cavity 1230 in the outer axial end of drive coupler 1220 having hub 1222 positioned in cavity 1230. Circumferential guide 1228 is sized to receive the corresponding drive coupler of the image forming device. One or more stops 1232 extend radially outward from hub 1222 and are spaced circumferentially from each other about hub 1222. An axial locking member 1234 extends circumferentially from one end of one or more of the stops 1232 in a direction counter to the operative rotational direction of drive coupler 1220. In the example embodiment illustrated, in operation, drive coupler 1220 turns in a counterclockwise direction as viewed in FIG. 10. As a result, in this embodiment, axial locking members 1234 extend in a clockwise direction from their respective stops 1232 as viewed in FIG. 10. Axial locking members 1234 are spaced axially outward from an axial end surface 1231 of cavity 1230 such that a pocket 1236 is formed between each axial locking member 1234 and surface 1231. Each axial locking member 1234 extends circumferentially part of the way from one stop 1232 to the next stop 1232 such that an axial opening 1238 is formed in the direction counter to the operative rotational direction of drive coupler 1220 (clockwise in the example embodiment as viewed in FIG. 10) between a distal end of the axial locking member 1234 and the next stop 1232. As discussed above, drive coupler 1220 may also include gear teeth 1240 on an outer radial portion of drive coupler 1220.

Figure 11:
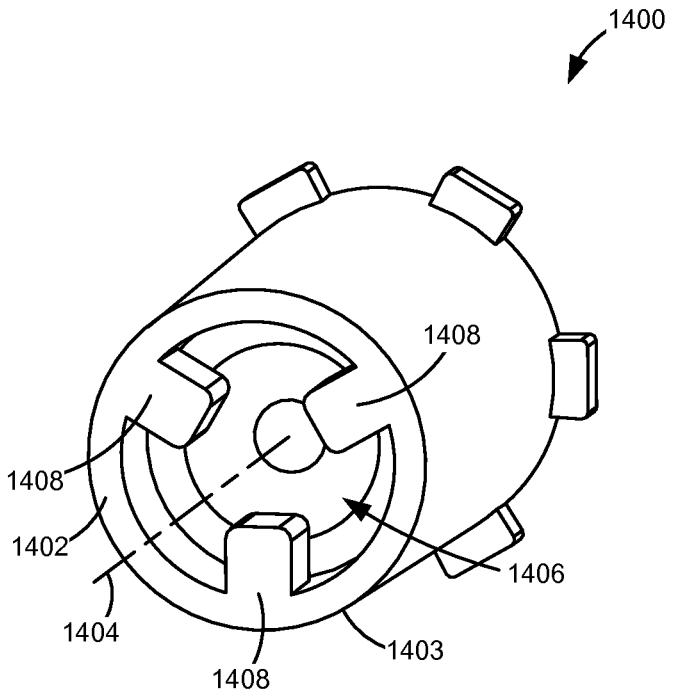
FIG. 11 is a perspective view of a corresponding drive coupler of the image forming device according to another example embodiment.

FIG. 11 shows a drive coupler 1400 of the image forming device according to one example embodiment. In the example embodiment illustrated, a front portion 1402 of drive coupler 1400 mates with drive coupler 1220. Drive coupler 1400 includes an axis of rotation 1404. Front portion 1402 of drive coupler 1400 includes an outer surface 1403 sized to fit in circumferential guide 1228. Drive coupler 1400 also includes a central opening 1406 sized to receive hub 1222 of drive coupler 1220. Hub 1222 and circumferential guide 1228 align drive coupler 1400 with drive coupler 1220 as the replaceable unit is inserted into the image forming device along insertion direction A as discussed above so that axis of rotation 1224 of drive coupler 1220 aligns with axis of rotation 1404 of drive coupler 1400. Drive coupler 1400 also includes one or more drive elements such as, for example, prongs 1408 extending radially inward into the area of central opening 1406.

Drive coupler 1400, like drive coupler 400, is biased toward drive coupler 1220 in order to ensure reliable contact between drive coupler 1400 and drive coupler 1220. When the replaceable unit is inserted into the image forming device and drive coupler 1220 mates with drive coupler 1400, prongs 1408 are received by axial openings 1238 of drive coupler 1220 as discussed above. When prongs 1408 of drive coupler 1400 are aligned with axial openings 1238 the replaceable unit is unlocked and may be freely removed from the image forming device. When drive coupler 1400 is rotated in the operative direction after engaging with drive coupler 1220 (counterclockwise as viewed in FIG. 10), prongs 1408 move from a position aligned with axial openings 1238 into pockets 1236 and against stops 1232. As drive coupler 1400 rotates further in the operative direction, the engagement between prongs 1408 and stops 1232 causes drive coupler 1220 to rotate with drive coupler 1400. In this orientation, prongs 1408 are aligned with axial locking members 1234 locking the replaceable unit in the image forming device. As discussed above, if a user tries to remove the replaceable unit from the image forming device, the engagement between prongs 1408 and axial locking members 1234 in the axial direction prevents the separation of drive coupler 1220 from drive coupler 1400. Removal of the replaceable unit from the image forming device is permitted upon rotating drive coupler 1400 counter to the operative direction (clockwise as viewed in FIG. 10) until prongs 1408 are aligned with axial openings 1238.

Figure 12:
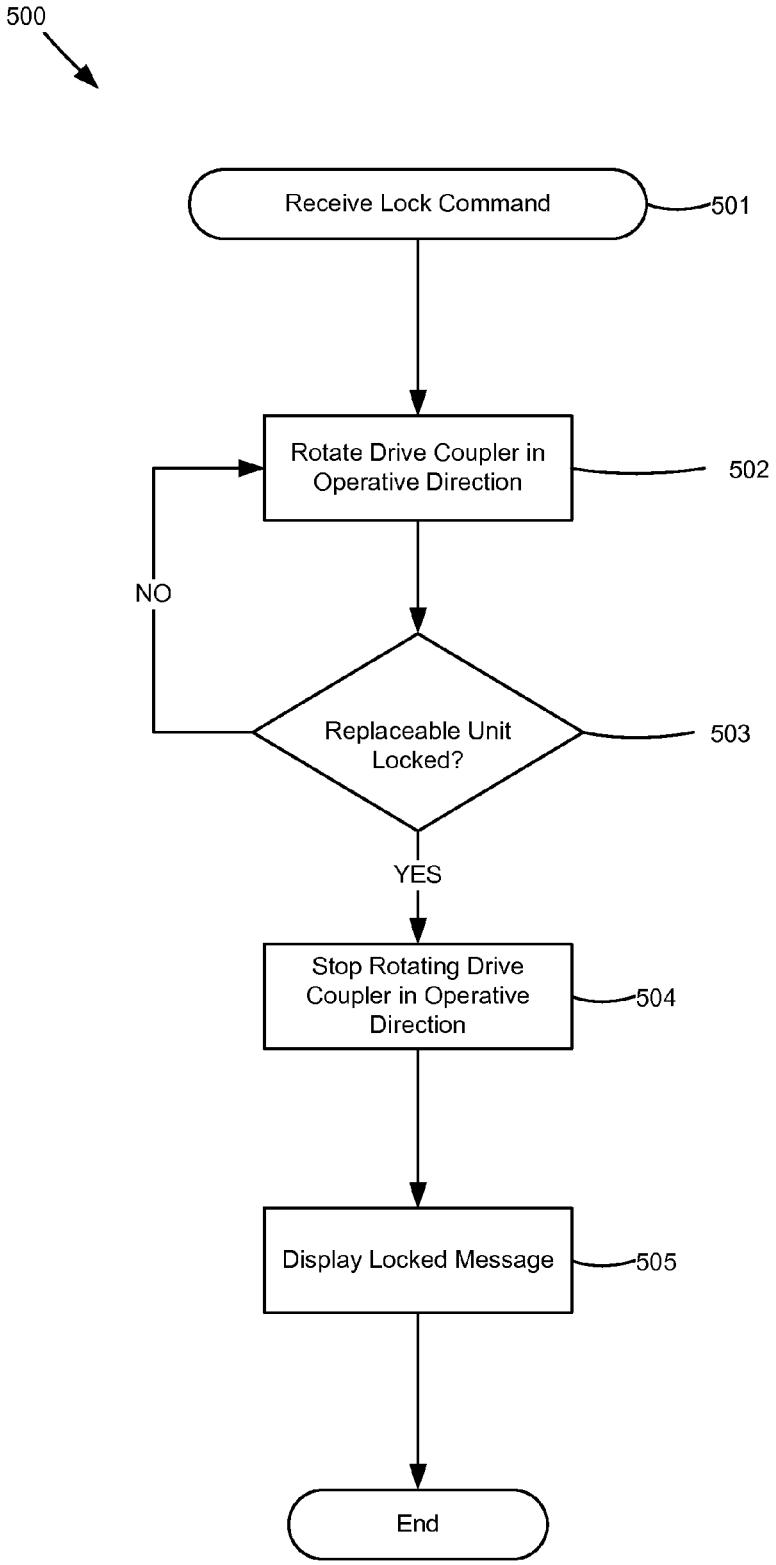
FIG. 12 is a flowchart showing a method for locking a replaceable unit in an image forming device according to one example embodiment.

FIG. 12 illustrates a method 500 for locking a replaceable unit such as toner cartridge 200 in the image forming device 100 or 100' according to one example embodiment. At step 501, the replaceable unit is installed in the image forming device and controller 102 receives a lock command. If a lock command is received without the replaceable unit installed in the image forming device, an error message may be displayed on user interface 104 and/or display monitor 36. In one embodiment, the lock command includes a user input at user interface 104. Some systems may permit any user including anonymous users to enter a lock command while others may only permit authorized or known users to enter a lock command. In another embodiment, the lock command is automatically triggered when the replaceable unit is installed in the image forming device such that no user input is required other than inserting the replaceable unit. The presence of the replaceable unit in image forming device may be detected using any conventional sensor known in the art such as, for example, an optical sensor or a mechanical flag sensor. Where the image forming device includes multiple replaceable units, the lock command may include an identification of the replaceable unit to be locked. Alternatively, the lock command may lock all replaceable units presently in an unlocked state such as those replaceable units recently installed in the image forming device.

At step 502, controller 102 rotates the drive coupler of the image forming device (such as drive coupler 400 or 1400) in the operative rotational direction using a conventional drive motor. As discussed above, upon rotating the drive coupler 400 or 1400 in the operative direction, prongs 408, 1408 enter into pockets 236, 1236 against stops 232, 1232 in alignment with axial locking members 234, 1234 that prevent the replaceable unit from being removed from the image forming device. At step 503, controller 102 monitors whether the replaceable unit is locked in the image forming device by determining whether prongs 408, 1408 have entered pockets 236, 1236 against stops 232, 1232. In one embodiment, controller 102 monitors the number of revolutions of the drive motor using an encoder wheel or the like and an accompanying sensor to determine whether the drive motor has rotated enough to ensure that prongs 408, 1408 are positioned against stops 232, 1232. In another embodiment, controller 102 monitors the torque on the drive motor, for example using a current sensor, to determine whether prongs 408, 1408 are positioned against stops 232, 1232. Once prongs 408, 1408 engage with stops 232, 1232, the torque on the drive motor will increase as a result of the force required to rotate drive coupler 220, 1220 and its associated components in addition to the force required to rotate drive coupler 400, 1400. If controller 102 determines that the replaceable unit is not yet locked, controller 102 continues to rotate the drive motor to rotate drive coupler 400, 1400 in the operative direction. When controller 102 determines that the replaceable unit is locked in the image forming device, controller 102 stops rotating drive coupler 400, 1400 at step 504 unless it is desired to continue operating the replaceable unit immediately. At step 505, a message may be displayed on user interface 104 and/or display monitor 36 confirming to the user that the replaceable unit is locked.

Figure 13:
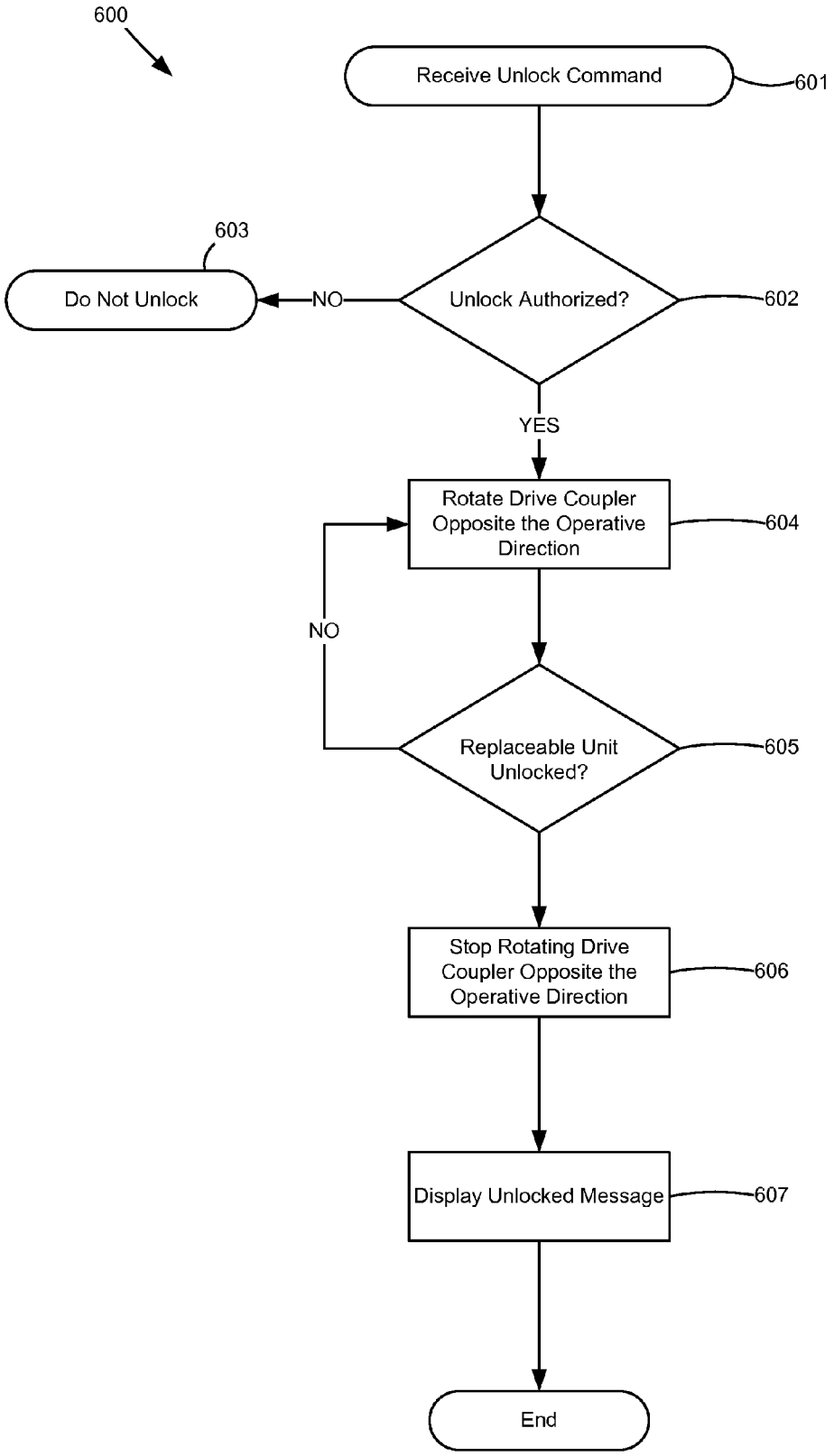
FIG. 13 is a flowchart showing a method for unlocking a replaceable unit from an image forming device according to one example embodiment.

FIG. 13 illustrates a method 600 for unlocking a replaceable unit such as toner cartridge 200 in the image forming device 100 or 100' according to one example embodiment. At step 601, controller 102 receives an unlock command. In one embodiment, the unlock command includes a user input at user interface 104. Where the image forming device includes multiple replaceable units, the unlock command may also include an identification of the replaceable unit to be unlocked. Alternatively, by default, the unlock command may unlock all replaceable units that are at the end of life unless specific replaceable units are identified by the user. In another alternative, the unlock command may simply unlock all replaceable units of the image forming device. At step 602, controller 102 determines whether the unlocking function is authorized. In one embodiment, in order to unlock the replaceable unit, a user must enter a pass code at user interface 104 or computer 30. In another embodiment, a user must identify himself or herself such as, for example, by entering login information at user interface 104 or by scanning an access badge or card such as proximity card (e.g., a radio frequency identification (RFID) card) or a magnetic stripe card. In this embodiment, only authorized users are permitted to unlock the replaceable unit from the image forming device. In some embodiments, the replaceable unit is automatically unlocked at the end of its life such as, for example, when a toner cartridge is out of usable toner or when a replaceable unit's components reach the end of their life due to wear but authorization is required to unlock a replaceable unit prior to the end of life. In other embodiments, authorization is always required to unlock the replaceable unit. In some embodiments, authorization is required prior to permitting the user to enter a command to unlock the replaceable unit. In other embodiments, authorization is requested after the command to unlock the replaceable unit has been entered. At step 603, if the user is not authorized to unlock the replaceable unit, access is denied and controller 102 does not unlock the replaceable unit.

If the user is authorized to unlock the replaceable unit, at step 604, controller 102 rotates the drive coupler of the image forming device (such as drive coupler 400 or 1400) in a direction counter to the operative rotational direction using the drive motor. As discussed above, upon rotating the drive coupler 400 or 1400 counter to the operative direction, prongs 408, 1408 clear pockets 236, 1236 and align with axial openings 238, 1238 permitting the separation of drive coupler 220, 1220 from drive coupler 400, 1400 and the removal of the replaceable unit from the image forming device. At step 605, controller 102 monitors whether the replaceable unit is unlocked. In one embodiment, controller 102 monitors the number of revolutions of the drive motor to determine whether the drive motor has rotated enough to ensure that prongs 408, 1408 are aligned with axial openings 238, 1238. In another embodiment, controller 102 monitors the torque on the drive motor as discussed above to determine whether prongs 408, 1408 are clear of axial locking members 234, 1234 and positioned against an adjacent stop 232, 1232 in alignment with axial openings 238, 1238. Once prongs 408, 1408 engage with the adjacent stops 232, 1232 in alignment with axial openings 238, 1238, the torque on the drive motor will increase as discussed above. If controller 102 determines that the replaceable unit is not yet unlocked, controller 102 continues to rotate the drive motor to rotate drive coupler 400, 1400 opposite the operative direction. When controller 102 determines that the replaceable unit is unlocked, controller 102 stops rotating drive coupler 400, 1400 at step 606. At step 607, a message may be displayed on user interface 104 and/or display monitor 36 confirming to the user that the replaceable unit is unlocked.

Accordingly, it will be appreciated that the present disclosure provides secure systems and methods for locking a replaceable unit in an image forming device through the engagement of a drive coupler of the replaceable unit with a corresponding drive coupler of the image forming device. The described systems and methods do not require maintenance of a key to the image forming device and typically allow unlocking and locking of the replaceable unit through interaction with user interface 104 of the image forming device. Further, the present disclosure provides a cost effective system of locking a replaceable unit in an image forming device. The amount of additional components required to add locking functionality to the image forming device is minimized because the locking functionality is provided through modification of components that are already required in the system, the drive couplers of the replaceable unit and the image forming device, as opposed to through addition of new components that only serve a locking function.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A method of locking a replaceable unit in an image forming device, comprising upon receiving a lock command with the replaceable unit installed in the image forming device and a drive coupler of the image forming device mated with a drive coupler of the replaceable unit at an axial end of the drive coupler of the replaceable unit, rotating the drive coupler of the image forming device in an operative rotational direction of the drive coupler of the replaceable unit until the drive coupler of the image forming device locks with the drive coupler of the replaceable unit preventing the drive coupler of the replaceable unit from axially disengaging from the drive coupler of the image forming device, further comprising monitoring a torque on a drive motor driving the drive coupler of the image forming device to determine whether the drive coupler of the image forming device is locked with the drive coupler of the replaceable unit.

2. The method of claim 1, wherein said rotating the drive coupler of the image forming device in the operative rotational direction of the drive coupler of the replaceable unit until the drive coupler of the image forming device locks with the drive coupler of the replaceable unit includes rotating the drive coupler of the image forming device in the operative rotational direction of the drive coupler of the replaceable unit until the drive coupler of the image forming device operatively engages the drive coupler of the replaceable unit and an axial locking member of one of the drive coupler of the replaceable unit and the drive coupler of the image forming device is positioned to prevent the drive coupler of the replaceable unit from axially disengaging from the drive coupler of the image forming device.

3. The method of claim 1, wherein receiving the lock command includes receiving a lock command automatically generated when the replaceable unit is installed in the image forming device.

4. The method of claim 1, wherein receiving the lock command includes receiving a user input to lock the replaceable unit in the image forming device.

5. The method of claim 1, wherein monitoring the torque on the drive motor driving the drive coupler of the image forming device includes monitoring an electrical current powering the drive motor.

6. A method of unlocking a replaceable unit from an image forming device, comprising upon receiving an unlock command with the replaceable unit installed in the image forming device and a drive coupler of the image forming device locked with a drive coupler of the replaceable unit at an axial end of the drive coupler of the replaceable unit, rotating the drive coupler of the image forming device in a direction opposite an operative rotational direction of the drive coupler of the replaceable unit until the drive coupler of the replaceable unit is free to axially disengage from the drive coupler of the image forming device, wherein receiving the unlock command includes receiving an unlock command automatically generated when the replaceable unit reaches the end of its usable life.

7. The method of claim 6, wherein said rotating the drive coupler of the image forming device in the direction opposite the operative rotational direction of the drive coupler of the replaceable unit until the drive coupler of the replaceable unit is free to axially disengage from the drive coupler of the image forming device includes rotating the drive coupler of the image forming device in the direction opposite the operative rotational direction of the drive coupler of the replaceable unit until a drive element of one of the drive coupler of the image forming device and the drive coupler of the replaceable unit clears an axial locking member of the other of the drive coupler of the image forming device and the drive coupler of the replaceable unit.

8. An image forming device configured to hold a replaceable unit installable in the image forming device, the image forming device comprising:

a drive coupler positioned to provide rotational force to a corresponding drive coupler of the replaceable unit when the replaceable unit is installed in the image forming device;

a drive motor operatively connected to the drive coupler of the image forming device to drive the rotational motion of the drive coupler of the image forming device; and at least one processor configured to:

rotate the drive motor to drive the drive coupler of the image forming device in an operative rotational direction of the drive coupler of the replaceable unit until the drive coupler of the image forming device locks with the drive coupler of the replaceable unit upon receiving a lock command with the replaceable unit installed in the image forming device and the drive coupler of the image forming device mated with but unlocked from the drive coupler of the replaceable unit;

rotate the drive motor to drive the drive coupler of the image forming device in a direction opposite the operative rotational direction of the drive coupler of the replaceable unit until the drive coupler of the image forming device unlocks from the drive coupler of the replaceable unit upon receiving an unlock command with the replaceable unit installed in the image forming device and the drive coupler of the image forming device locked with the drive coupler of the replaceable unit; and monitor a torque on the drive motor to determine whether the drive coupler of the image forming device is locked with the drive coupler of the replaceable unit.

9. The image forming device of claim 8, wherein the at least one processor is configured to automatically rotate the drive motor to drive the drive coupler of the image forming device in the operative rotational direction of the drive coupler of the replaceable unit until the drive coupler of the image forming device locks with the drive coupler of the replaceable unit when the replaceable unit is installed in the image forming device.

10. The image forming device of claim 8, wherein the at least one processor is configured to automatically rotate the drive motor to drive the drive coupler of the image forming device in the direction opposite the operative rotational direction of the drive coupler of the replaceable unit until the drive coupler of the image forming device unlocks from the drive coupler of the replaceable unit when the replaceable unit reaches the end of its usable life.

11. The image forming device of claim 8, wherein the at least one processor is configured to rotate the drive motor to drive the drive coupler of the image forming device in the operative rotational direction of the drive coupler of the replaceable unit until the drive coupler of the image forming device locks with the drive coupler of the replaceable unit upon receiving a user input to lock the replaceable unit in the image forming device.

12. The image forming device of claim 8, wherein the at least one processor is configured to rotate the drive motor to drive the drive coupler of the image forming device in the direction opposite the operative rotational direction of the drive coupler of the replaceable unit until the drive coupler of the image forming device unlocks from the drive coupler of the replaceable unit upon receiving a user input to unlock the replaceable unit from the image forming device.

13. The image forming device of claim 12, wherein the at least one processor is configured to determine whether the received user input to unlock the replaceable unit from the image forming device is authorized and to rotate the drive motor to drive the drive coupler of the image forming device in the direction opposite the operative rotational direction of the drive coupler of the replaceable unit until the drive coupler of the image forming device unlocks from the drive coupler of the replaceable unit if the received unlock command is authorized.

14. The image forming device of claim 8, wherein the at least one processor is configured to monitor the torque on the drive motor by monitoring an electrical current powering the drive motor.

15. A method of locking a replaceable unit in an image forming device, comprising upon receiving a lock command with the replaceable unit installed in the image forming device and a drive coupler of the image forming device mated with a drive coupler of the replaceable unit at an axial end of the drive coupler of the replaceable unit, rotating the drive coupler of the image forming device in an operative rotational direction of the drive coupler of the replaceable unit until the drive coupler of the image forming device locks with the drive coupler of the replaceable unit preventing the drive coupler of the replaceable unit from axially disengaging from the drive coupler of the image forming device, further comprising monitoring the number of revolutions of the drive coupler of the image forming device to determine whether the drive coupler of the image forming device is locked with the drive coupler of the replaceable unit.

16. An image forming device configured to hold a replaceable unit installable in the image forming device, the image forming device comprising:

a drive coupler positioned to provide rotational force to a corresponding drive coupler of the replaceable unit when the replaceable unit is installed in the image forming device;

a drive motor operatively connected to the drive coupler of the image forming device to drive the rotational motion of the drive coupler of the image forming device; and at least one processor configured to:

rotate the drive motor to drive the drive coupler of the image forming device in an operative rotational direction of the drive coupler of the replaceable unit until the drive coupler of the image forming device locks with the drive coupler of the replaceable unit upon receiving a lock command with the replaceable unit installed in the image forming device and the drive coupler of the image forming device mated with but unlocked from the drive coupler of the replaceable unit;

rotate the drive motor to drive the drive coupler of the image forming device in a direction opposite the operative rotational direction of the drive coupler of the replaceable unit until the drive coupler of the image forming device unlocks from the drive coupler of the replaceable unit upon receiving an unlock command with the replaceable unit installed in the image forming device and the drive coupler of the image forming device locked with the drive coupler of the replaceable unit; and monitor a number of revolutions of the drive coupler of the image forming device to determine whether the drive coupler of the image forming device is locked with the drive coupler of the replaceable unit.

17. An image forming device configured to hold a replaceable unit installable in the image forming device, the image forming device comprising:

a drive coupler positioned to provide rotational force to a corresponding drive coupler of the replaceable unit when the replaceable unit is installed in the image forming device;

a drive motor operatively connected to the drive coupler of the image forming device to drive the rotational motion of the drive coupler of the image forming device; and at least one processor configured to:

rotate the drive motor to drive the drive coupler of the image forming device in an operative rotational direction of the drive coupler of the replaceable unit until the drive coupler of the image forming device locks with the drive coupler of the replaceable unit upon receiving a lock command with the replaceable unit installed in the image forming device and the drive coupler of the image forming device mated with but unlocked from the drive coupler of the replaceable unit; and rotate the drive motor to drive the drive coupler of the image forming device in a direction opposite the operative rotational direction of the drive coupler of the replaceable unit until the drive coupler of the image forming device unlocks from the drive coupler of the replaceable unit upon receiving an unlock command with the replaceable unit installed in the image forming device and the drive coupler of the image forming device locked with the drive coupler of the replaceable unit, wherein the at least one processor is configured to automatically rotate the drive motor to drive the drive coupler of the image forming device in the direction opposite the operative rotational direction of the drive coupler of the replaceable unit until the drive coupler of the image forming device unlocks from the drive coupler of the replaceable unit when the replaceable unit reaches the end of its usable life.

* * * * *